United States Patent [19]

Dillner et al.

[11] Patent Number: 4,811,437

[45] Date of Patent: Mar. 14, 1989

[54] FOLDABLE PLAYYARD

[75] Inventors: James M. Dillner, Lancaster; Nathanael Saint, Morgantown, both of Pa.

[73] Assignee: Graco Metal Products, Inc., Elverson, Pa.

[21] Appl. No.: 67,741

[22] Filed: Jun. 26, 1987

[51] Int. Cl.[4] ..... A47D 7/00

[52] U.S. Cl. ..... 5/99 B; 5/93 R; 5/99 A; 5/99 C

[58] Field of Search ..... 5/93 R, 98 R, 99 R, 5/99 A, 99 B, 99 C, 493

[56] References Cited

U.S. PATENT DOCUMENTS

| | | | |
|---|---|---|---|
| 1,374,333 | 4/1921 | Stotler et al. . | |
| 1,413,068 | 4/1922 | Stotler et al. . | |
| 2,464,866 | 3/1949 | Holtz . | |
| 2,490,296 | 12/1949 | Fournier . | |
| 2,498,203 | 2/1950 | Fischer . | |
| 2,561,637 | 7/1951 | Rex . | |
| 2,569,937 | 10/1951 | Lindgren . | |
| 2,607,052 | 8/1952 | Le Roy . | |
| 2,617,999 | 12/1952 | Mitchell . | |
| 2,629,110 | 2/1953 | Fournier . | |
| 2,659,903 | 11/1953 | Hagelfeldt . | |
| 2,784,420 | 3/1957 | Moltane . | |
| 2,901,755 | 9/1959 | Wood, Jr. . | |
| 2,908,021 | 10/1959 | Fulton | 5/98 R X |
| 2,922,169 | 1/1960 | Werner | 5/98 R |
| 2,942,750 | 6/1960 | Neely . | |
| 3,091,249 | 5/1963 | O'Neil . | |
| 3,165,760 | 1/1965 | Abajian . | |
| 3,183,528 | 5/1965 | Jacobs et al. . | |
| 3,605,139 | 9/1971 | Lorentz, Jr. . | |
| 3,789,439 | 2/1974 | Berg et al. | 5/99 C |
| 3,924,280 | 12/1975 | Vaiano | 5/99 R |
| 4,008,497 | 2/1977 | Bader | 5/99 C |
| 4,008,499 | 2/1977 | Wren, Jr. et al. | 5/99 C |
| 4,069,524 | 1/1978 | Carlo | 5/99 B |
| 4,070,716 | 1/1978 | Satt et al. | 5/99 C |
| 4,073,017 | 2/1978 | Stevens | 5/99 B X |
| 4,186,454 | 2/1980 | Cone | 5/99 R |
| 4,202,065 | 5/1980 | Sullivan | 5/99 A |
| 4,357,735 | 11/1982 | Saint et al. | 5/99 B X |
| 4,376,318 | 3/1983 | Cirillo | 5/99 C |
| 4,538,309 | 9/1985 | Gunter | 5/99 B |
| 4,561,138 | 12/1985 | Hwang | 5/99 R |
| 4,573,224 | 3/1986 | Saint | 5/99 C |
| 4,688,280 | 8/1987 | Kohus et al. | 5/99 R |
| 4,703,525 | 11/1987 | Shamie | 5/99 R |

FOREIGN PATENT DOCUMENTS

| | | |
|---|---|---|
| 0952496 | 8/1974 | Canada . |
| 043051 | 8/1887 | Fed. Rep. of Germany . |
| 0481037 | 7/1929 | Fed. Rep. of Germany . |
| 1557841 | 7/1969 | France . |
| 2361846 | 3/1978 | France . |

*Primary Examiner*—Ramon O. Ramirez

*Attorney, Agent, or Firm*—Panitch, Schwarze, Jacobs & Nadel

[57] ABSTRACT

Foldable playyard comprising upper and lower frame assemblies. The lower frame assembly comprises a unitary central hub member, corner leg connecting members preferably in the form of support feet, and hub legs diverging radially outwardly from the hub member. The upper frame assembly includes corner rail connecting members and pairs of in-line side rails which are pivotably coupled at their outer ends to adjacent corner rail connecting members and at their inner ends to a medial rail connecting member. Corner legs interconnect and are freely coupled to the upper and lower frame assemblies. In one embodiment, the medial rail connecting member houses a hand releasable latch mechanism. In other embodiments, a hand releasable latch mechanism is rotatable with the side rails between latched and released positions. When the playyard is erected, the hub legs and side rails maintain the corner legs upstanding in a spread configuration. When the hub legs and side rails are collapsed, they draw the corner legs towards the hub member and into a compact configuration. For safety purposes, the rail pairs cannot be collapsed unless the latch mechanism is released. A discrete foldable floor having rigid sections is foldable into a box-shape for carrying the collapsed playyard.

26 Claims, 13 Drawing Sheets

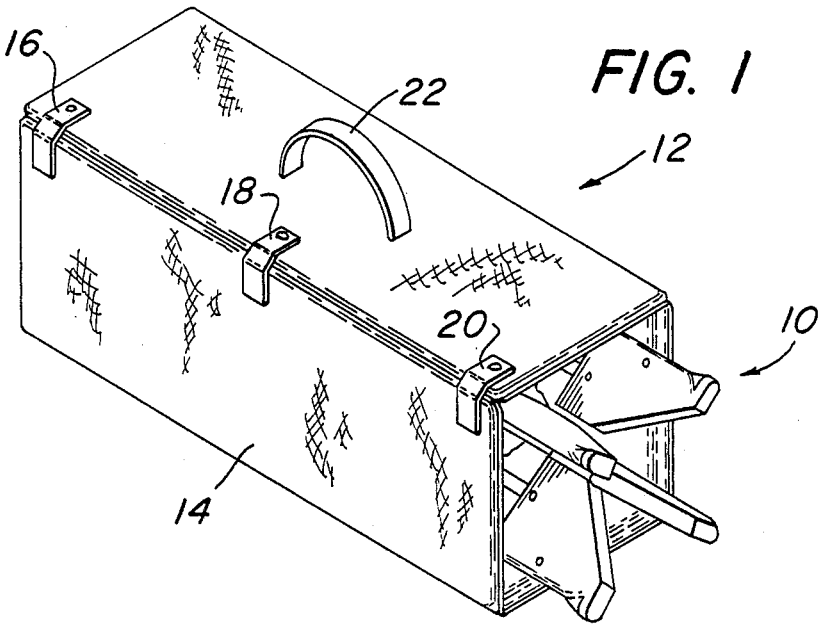
FIG. 1
FIG. 2
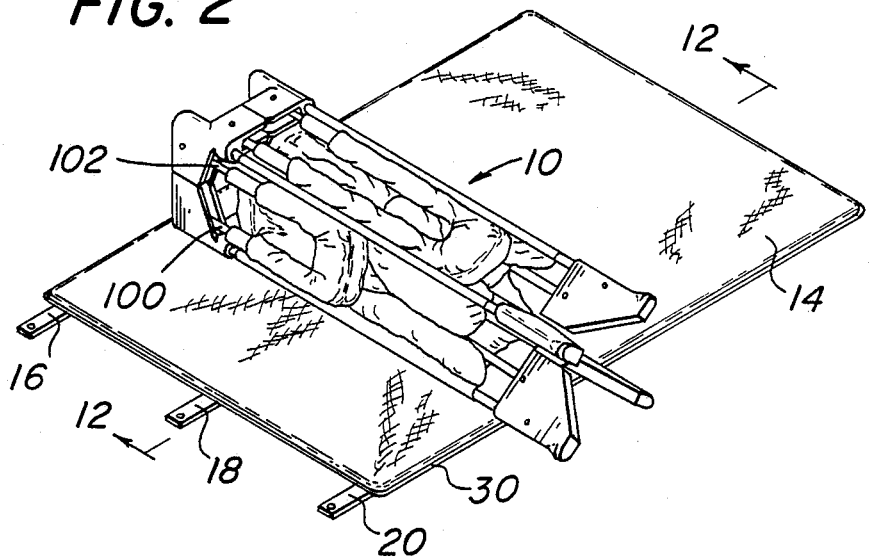

FIG. 9
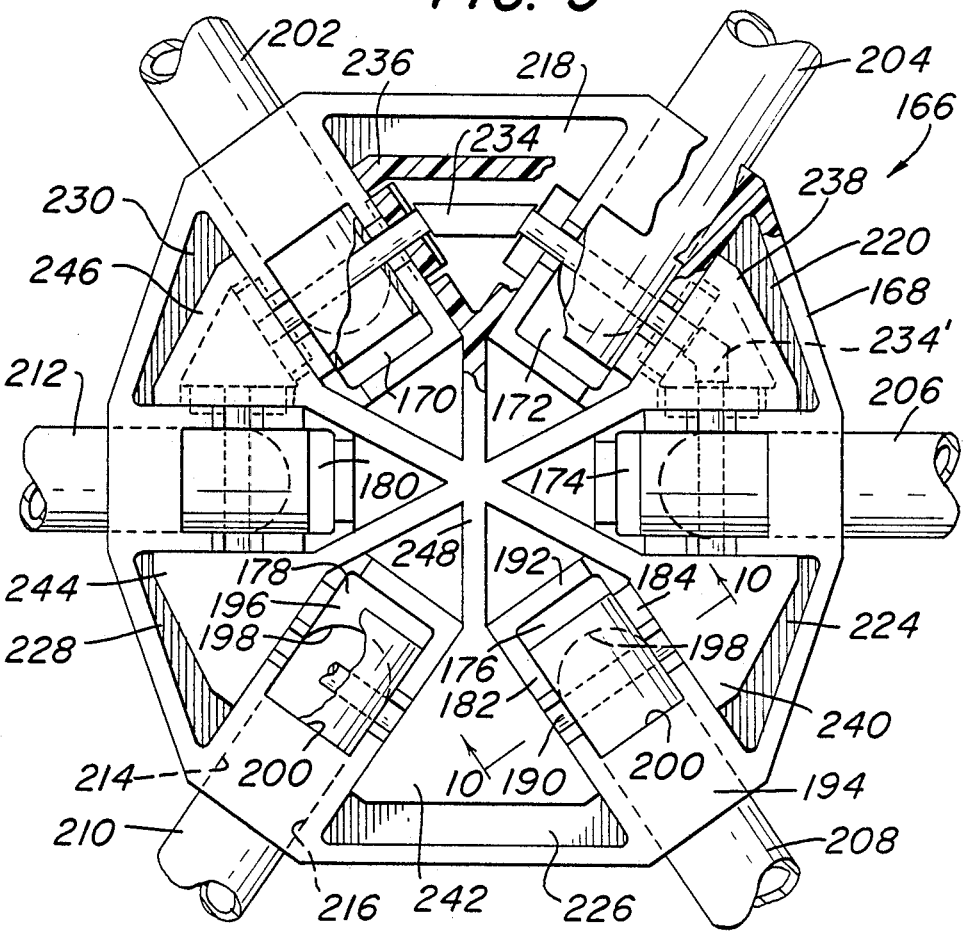
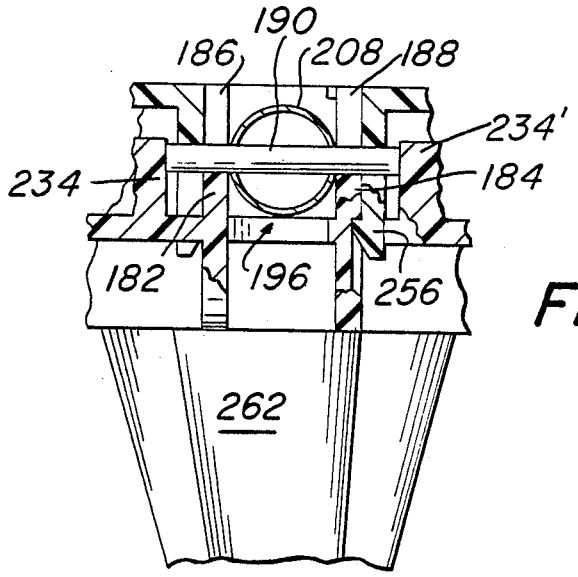
FIG. 10

FOLDABLE PLAYYARD

BACKGROUND OF THE INVENTION

The present invention is directed to a children's playyard of the foldable type. Foldable playyards having upstanding corner legs are generally known. A foldable playyard, when erected, should be stable; it should provide maximal support so as to keep the corner legs upstanding. For maximum convenience, a foldable playyard should be readily collapsible to a storage position without disassembly of any parts. In the storage position, the playyard should be easily transportable from one location to another.

The problem solved by the present invention is that of providing a playyard of a simplified structure having upper and lower frame assemblies, which is easily erected without re-assembly of any parts, which provides maximal support for upstanding corner legs, which is easily collapsible without disassembly of any parts, and which can be readily transported from one location to another in a collapsed condition.

BRIEF SUMMARY OF THE INVENTION

Foldable playyard comprising upper and lower frame assemblies. The lower frame assembly comprises a unitary central hub member, corner leg connecting members and hub legs each pivotably coupled at one end portion to the hub member and pivotably coupled at an opposite end portion to one of the corner leg connecting members such that the hub legs are collapsible from a substantially horizontal co-planar spread configuration wherein the hub legs diverge radially outwardly from the hub member to a compact non-coplanar configuration wherein the hub legs are substantially parallel. The upper frame assembly includes corner rail connecting members and side rail means each comprising a pair of rails and a medial rail connecting member disposed therebetween. Each of the rails is pivotably coupled at one end portion to one of the corner rail connecting members and is pivotably coupled at an opposite end portion to the medial rail connecting member such that the pair of rails is collapsible from a substantially in-line configuration to a generally V-shaped configuration. Corner legs are each fixedly coupled at one (lower) end portion to one of the support feet and at an opposite (upper) end portion to one of the corner rail connecting members such that the corner legs are collapsible radially inwardly towards the hub member from a substantially parallel configuration wherein the corner legs are spread apart by the hub legs and side rail means to a substantially parallel compact configuration wherein the corner legs are drawn together by the hub legs and side rail means.

In one embodiment of the foldable playyard, each of the side rail means includes latch means for automatically latching the pair of rails in a substantially in-line configuration by pivoting the pair of rails and hand manipulable latch release means for releasing the pair of rails from the in-line configuration.

In two further embodiments, each of the rails is pivotably coupled at one end portion to the medial rail connecting member and is coupled at an opposite end portion to one of the corner rail connecting members such that each rail is rotatable about its longitudinal axis together with the medial rail connecting member and is pivotable with respect to the corner rail connecting member. In these embodiments of the playyard, each of the side rail means includes means for automatically latching the pair of rails in a substantially in-line configuration by rotation of the pair of rails together with the medial rail connecting member and for releasing the pair of rails from the in-line configuration by opposite rotation of the pair of rails together with the medial rail connecting member. For the purpose of illustrating the invention, there is shown in the drawings forms which are presently preferred; it being understood, however, that this invention is not limited to the precise arrangements and instrumentalities shown.

BRIEF DESCRIPTION OF THE DRAWINGS

FIG. 1 is a perspective of the foldable playyard in a collapsed position, housed within a carrying case formed by a discrete floor.

FIG. 2 is a perspective of the collapsed playyard with the foldable floor unfolded.

FIG. 9 is a top plan of the hub member.

FIG. 10 is a section taken along 10—10 in FIG. 9.

DETAILED DESCRIPTION OF INVENTION

Figure 3:
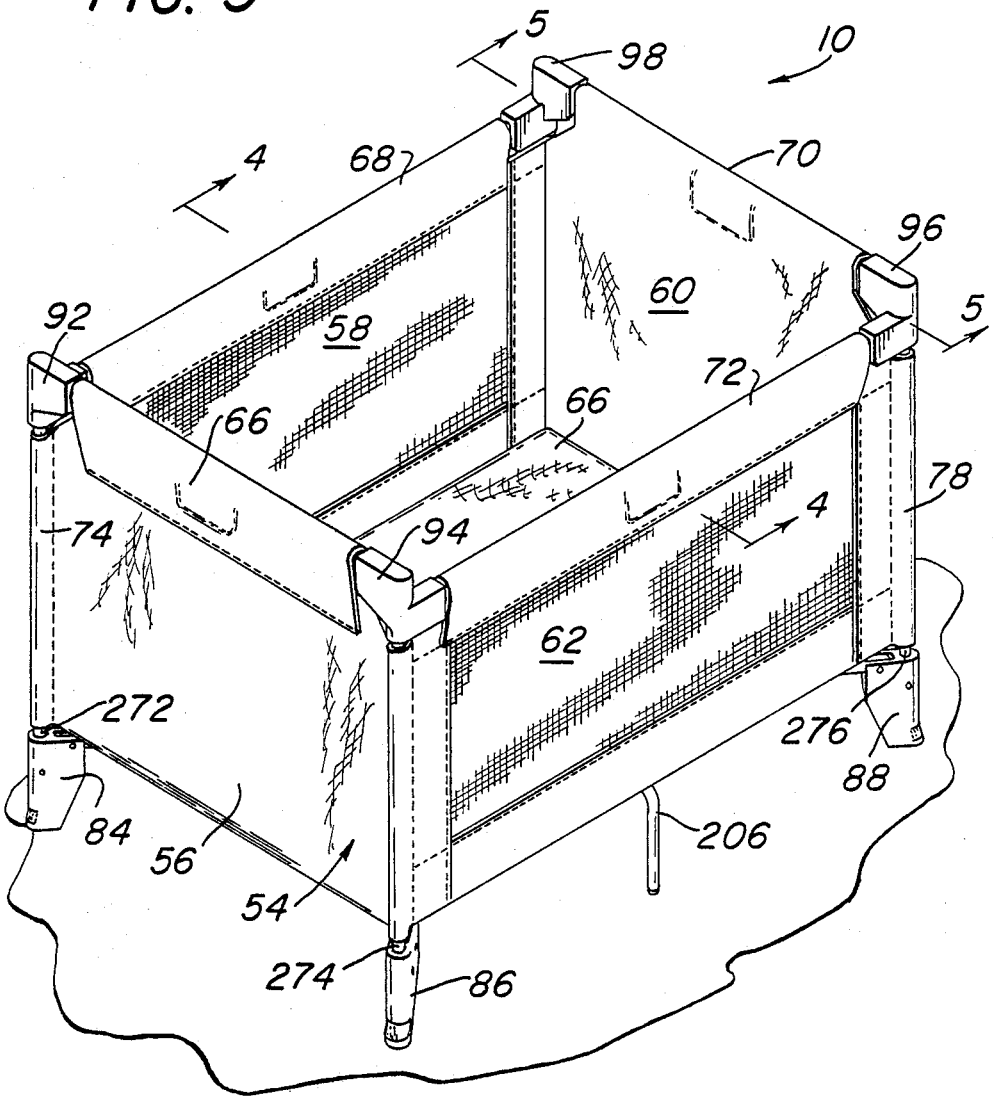
FIG. 3 is a perspective of the foldable playyard in the erected state wherein the playyard is ready for use.
Figure 12:
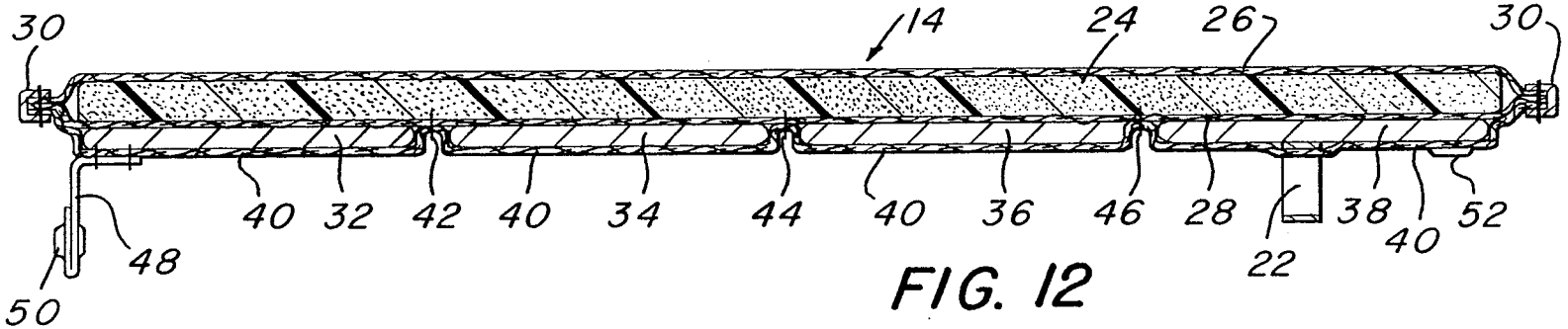
FIG. 12 is a section taken along 12—12 in FIG. 2.

Referring to the drawings, wherein like numerals indicate like elements, there is shown in FIG. 1 a perspective of the foldable playyard 10 of the present invention in its collapsed state and housed within a box-shaped carrying case 12 formed by a discrete foldable floor 14 having snap fasteners 16, 18, 20 and a carrying handle 22. The foldable floor 14 comprises a foam cushion 24 enclosed within layers 26, 28 of fabric material such as nylon. See FIG. 12. Fabric layers 26, 28 are stitched together along their peripheries and to a fabric edging 30. The foldable floor 14 is partitioned into four sections, each containing one of four rigid panels 32, 34,

36, 38. Each panel may be made from a Masonite material. Each panel is disposed between fabric material 28 and a like layer of fabric material 40 which is stitched along its periphery to layers 26, 28 and runner 30. Fabric material 40 is also stitched to fabric material 28 along parallel seams 42, 44, 46. Seams 42, 44, 46 partition the floor 14 into the four sections, each section containing one of the panels 32, 34, 36, 38. The sections are foldable about seams 42, 44, 46 into the box-shaped configuration shown in FIG. 1. Each of the snap fasteners 16, 18, 20 comprises a flexible strap 48 stitched to material 40 and provided with a snap fastener structure 50 as shown in FIG. 12. Each snap fastener 16, 18, 20 releasably attaches to one of three mating snap fastener structures 52 on an opposite side of the floor 14. In use, the floor 14 is unfolded as shown in FIG. 2 and inserted in the erected playyard as shown in FIG. 3 with the material 26 forming a smooth play surface for the child. Thus, the child does not contact any seam or stitching on the floor.

The foldable playyard 10 includes a flexible enclosure 54 comprising side panel portions 56, 58, 60, 62 and a floor portion 66. These portions of the enclosure are stitched together to form a unitary flexible structure. If desired, side panel portions 58, 62 may be provided with netting as shown in FIG. 3 so as to enhance ventilation and to allow the child to see and be seen. Each of the side panel portions 56, 58, 60, 62 includes a laterally extending tubular sleeve 66, 68, 70 or 72. The side panel portions are joined together by vertically extending tubular sleeves 74, 76, 78, 80. The sleeves facilitate mounting of the enclosure on the playyard frame as described hereafter.

The lower portion of the playyard frame includes rigid (identical) corner leg connecting members 84, 86, 88, 90 preferably in the form of support feet as shown in FIGS. 1–4. The upper portion of the frame includes rigid corner rail connecting members 92, 94, 96, 98. See FIGS. 3 and 4. The support feet and corner rail connecting members may be molded from a polymeric plastic material such as ABS. Each pair of adjacent corner rail connecting members supports a side rail means (shown but not numbered) at the upper portion of the playyard frame. Referring to FIG. 5, each side rail means includes a pair of rigid, tubular metal rails 100, 102 which may be made from 22 gauge steel. End portion 104 of rail 100 is received within a corner rail connecting member (98) and is pivotably coupled to the corner rail connecting member by a rivet pin 106 extending through aligned openings in the corner rail connecting member and the rail end portion. The opposite end portion 108 of rail 100 extends within and is pivotably coupled to a medial rail connecting member 110 by a rivet 112 extending through aligned openings in the medial rail connecting member and the rail end portion. See FIGS. 5 and 7. Medial rail connecting member 110 is preferably made of a rigid metal material and is cut out at 116 and 116′ to facilitate pivoting of rails 100, 102. Referring to FIG. 5, end portion 114 of rail 102 extends within and is pivotably coupled to an associated corner rail connecting member (96) by a rivet pin 117 in the same manner as end portion 104 of rail 100 and its associated corner rail connecting member (98). The opposite end portion of rail 102 extends within and is pivotably coupled to medial rail connecting member 110 in the same manner as end portion 108 of rail 100.

The medial rail connecting member 110 houses a latch mechanism for automatically latching rails 100, 102 in a substantially in-line configuration when the playyard is erect as shown in FIG. 5. The latch mechanism includes a pair of sprung pin members 122, 124. Each pin member is made of a rigid polymeric plastic material and includes a nose portion 126 and flexible legs 128, 130. Legs 128, 130 partially enclose a spring chamber (shown but not numbered), within which a compression spring 132 is housed, and have rib-type projections 134, 136 respectively. Each sprung pin member is assembled by inserting spring 132 in the spring chamber and then telescoping the pin member into the rail end portion (108 or 118) as shown by broken lines in FIG. 7. Before the pin member is telescoped within the rail end portion, the rail (100 or 102) is pivotably coupled to the medial rail connecting member 110 by the rivet pin (112 or 120). The pin member is then inserted in the rail end portion so that ribs 134, 136 contact the rivet pin (112 or 120) thereby spreading legs 128, 130 until the ribs clear the rivet pin. Legs 128, 130 then snap back in place so that the pin member is captured on the rivet pin. Spring 132 is then captured between the rivet pin and an end wall (shown in FIG. 5 but not numbered) of the spring chamber.

Although one side rail means and latch mechanism have been described in connection with side rails 100, 102, medial connecting member 110, pin members 122, 124 and corner rail connecting members 96, 98, it should be understood that identical side rail means and latch mechanisms are provided between each adjacent pair of corner rail connecting members. The lengths of the rail pairs which are part of each side rail means is determined by the width of the side of the playyard on which the side rail means is located as can be appreciated from inspection of FIG. 3.

Figure 7:
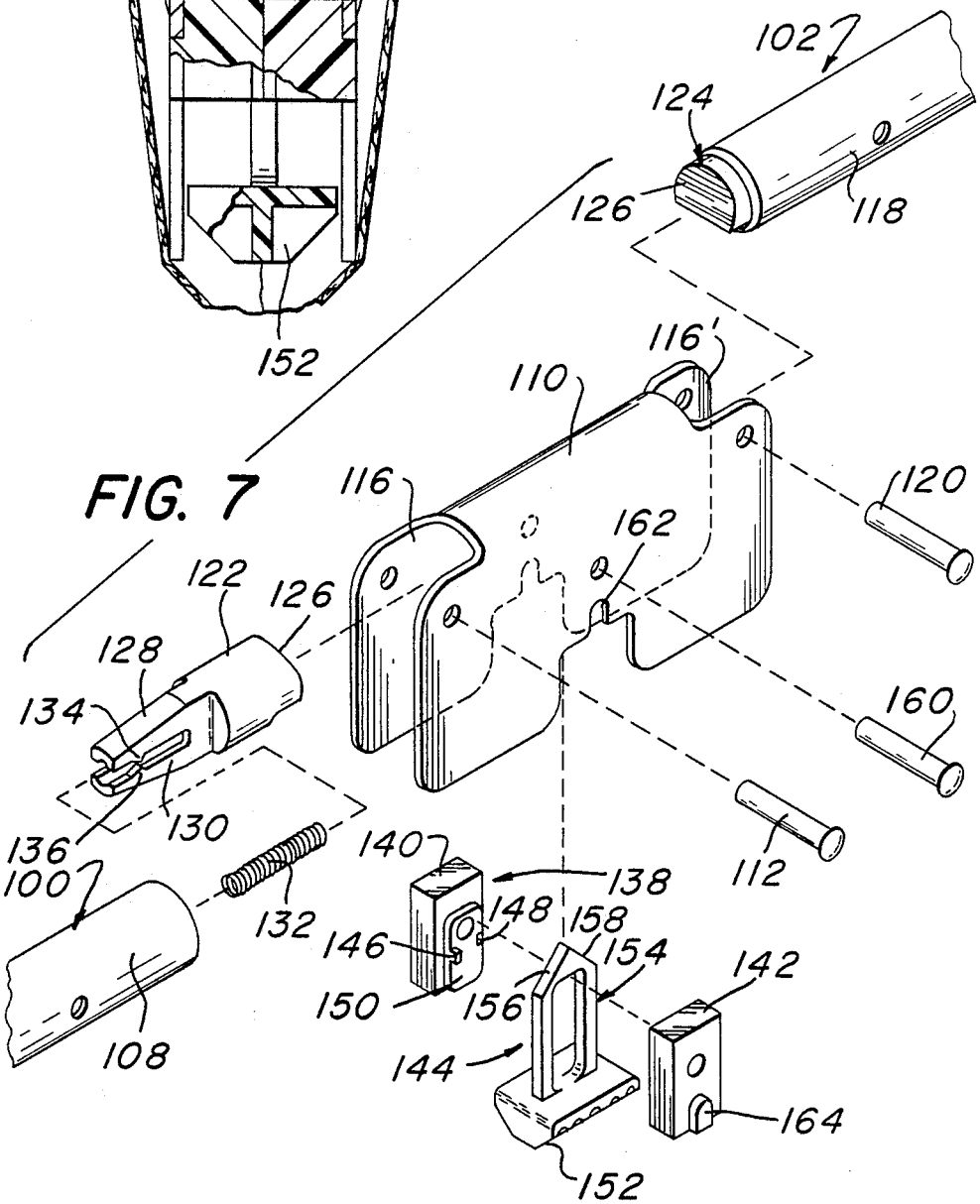
FIG. 7 is an exploded perspective of the latch mechanism.

Before rails 100, 102 are pivotably coupled to medial rail connecting member 110 and pin members 122, 124 are sprung in the rails, a portion of the latch mechanism comprising a holding member 138 (having interlocking halves 140, 142 as shown in FIG. 7) is secured to the medial rail connecting member together with a latch release mechanism 144. Each holding member half is provided with a lug 146 and a notch 148. Each lug-notch configuration is a mirror image of the other so that the holding member halves can be matingly interlocked prior to insertion in the medial rail connecting member. Each lug-notch configuration is formed on a land 150 which acts as a guide for the latch release mechanism 144. The latch release mechanism 144 includes a hand manipulable portion 152 and a slotted key portion 154 having converging cam surfaces 156, 158. See FIG. 7. In assembling the holding member and latch release mechanism, land 150 of one of the holding member halves (140, 142) is located inside the slotted portion of key 154. The two holding member halves are then matingly interlocked by the lug and notch pairs. The assembled holding member 138 and latch release mechanism 144 is then secured to medial rail connecting member 110 by a rivet pin 160 which extends through the slotted portion of key 154 and aligned openings in holding member halves 140, 142 and the medial rail connecting member. To assist in locating the assembled holding member and latch release mechanism within medial rail connecting member 110, each side of the medial rail connecting member is provided with a notch 162 and the outer face of each holding member half 140, 142 is provided with a matching lug 164.

After the holding member 138 and latch release mechanism 144 are assembled and secured to the medial rail connecting member 110, the rails 100, 102 are pivotably coupled to the medial rail connecting member, and the pin members 122, 124 are sprung in the rails as previously explained. The entire assembly is then inserted in the laterally extending sleeve (70) of a side panel portion of the flexible enclosure. The outer end portions 104, 114 of the rails are then pivotably coupled to the associated corner rail connecting members (96, 98) as shown in FIG. 5. The process is repeated to assemble each of the side rail means, for each side of the playyard.

Figure 11:
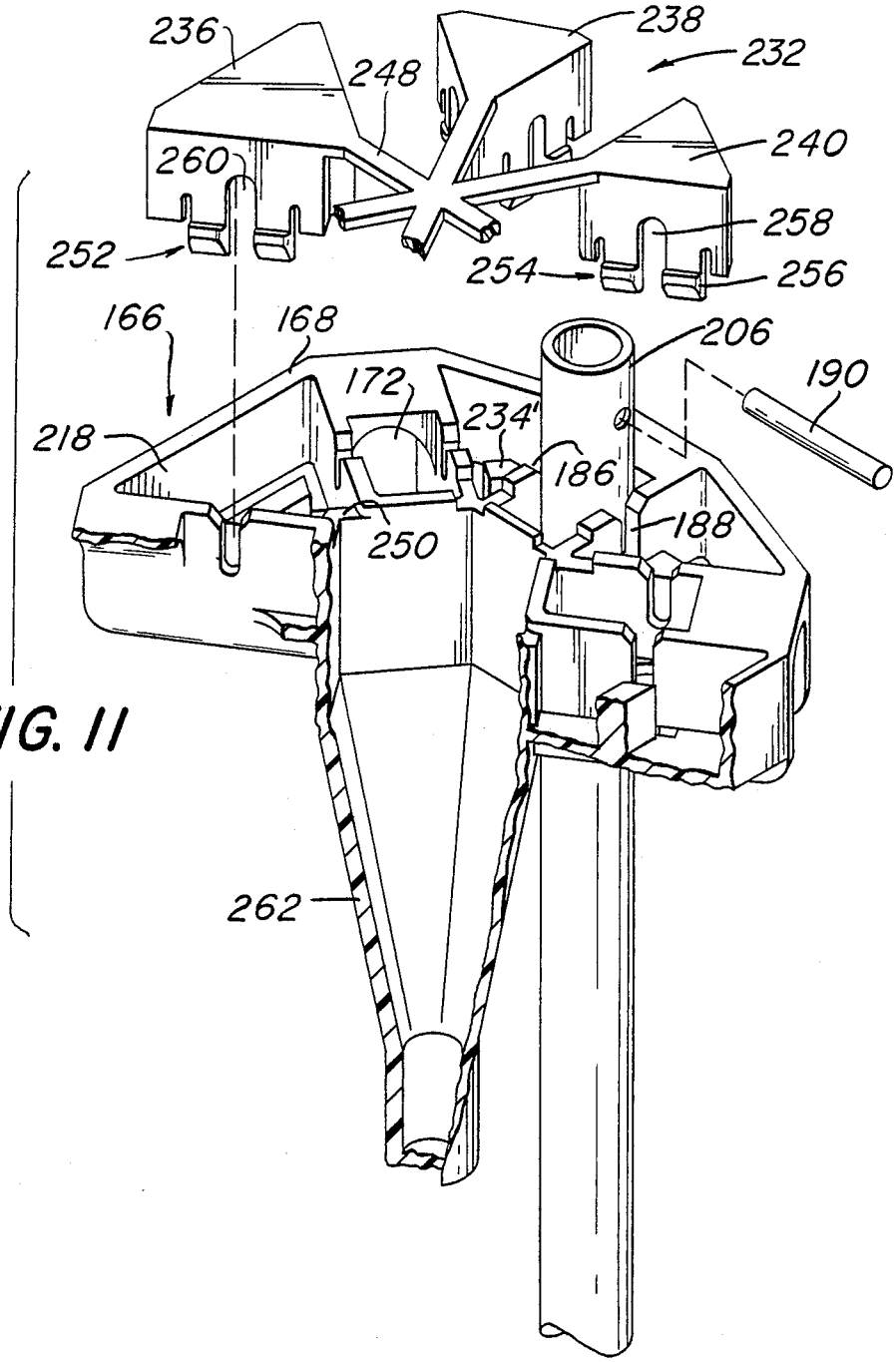
FIG. 11 is an exploded perspective of the components of the hub member.

The lower portion of the playyard frame comprises a unitary central hub member 166 as best shown in FIGS. 9–11. Central hub member 166 includes a generally hexagonal shaped body member 168 having leg receiving sockets 170, 172, 174, 176, 178, 180. As shown in FIG. 9, each leg receiving socket includes a pair of walls 182, 184 provided with slots 186, 188 respectively for receiving a pivot pin 190. Each leg receiving socket also includes an end wall 192, a partial top wall 194, and a partial bottom wall 196 having an arcuate edge 198. Bottom wall edge 198 and an edge 200 of top wall 194 provide the vertical boundaries for an opening through which a rigid, tubular metal hub leg 202, 204, 206, 208, 210 or 212 is dropped to first assemble the hub leg in the leg receiving socket. Hub legs 202, 204, 208 and 210 are identical and may be made from 22 gauge steel. The hub legs are also part of the lower portion of the playyard frame. Each hub leg is provided with aligned, diametrically opposed openings at an end portion thereof for receiving the pivot pin 190. With the pivot pin inserted through the hub leg, the leg is dropped in the associated leg receiving socket as shown in FIG. 11. Opposite end portions of the pivot pin seat in the socket wall notches 186, 188. The socket walls 182, 184 are spaced apart so as to provide a clearance for the hub leg at the region between bottom and top wall edges 198, 200 so as to facilitate insertion by dropping the leg in the socket. The inside surfaces 214, 216 of walls 182, 184 converge slightly at the region of top wall 194 so as to frictionally engage the end portion of the hub leg when it is swung to the horizontal position about pivot pin 190 to erect the playyard. The undersurface of top wall 194 contacts the hub leg so that the hub leg is engaged on four sides, by walls 182, 184, 194, 196 when it is swung to the horizontal position.

As shown in FIG. 9, adjacent hub leg receiving sockets are spaced apart by triangular-shaped wells 218, 220, 224, 226, 228 and 230. Enlarged wells 218, 226 are of like dimensions. Wells 220, 224, 228 and 230 are of like dimensions but are reduced in size as compared with wells 218, 226. The leg receiving sockets are oriented as shown in FIG. 9 so that hub legs diverge radially outwardly from hub member 166 in a common plane when the legs are pivoted to the horizontal position to erect the playyard. To collapse the playyard, the hub legs are pivoted to a compact non-coplanar configuration wherein the legs are substantially parallel.

After each of the hub legs is inserted in the leg receiving sockets, a spider 232 is snap fastened to the body member 168 to secure the pivot pins 190 in place. See FIG. 11. The central hub member 166 and spider 232 are preferably molded from a rigid polymeric plastic material such as ABS. Each of the triangular-shaped wells 218, 220, 224, 226, 228, 230 is provided with a rib 234, the ribs in adjacent wells being designated 234, 234' in FIGS. 9 and 10. Each rib projects from the bottom wall of its well so as to prevent lateral movement of the pivot pins in adjacent leg receiving sockets. Ribs 234 have a generally straight configuration and are located in enlarged wells 218, 226. Ribs 234' are angled at a medial portion and are located in reduced wells 220, 224, 228 and 230.

The spider 232 is provided with triangular-shaped fasteners 236, 238, 240, 242, 244 and 246 which are coupled by radial legs 248 as shown in FIGS. 9 and 11. Legs 248 locate in notches 250 formed along the central wall portion of body member 168. Each triangular-shaped fastener is sized so as to seat snugly in its associated well and is provided along its side walls with pairs 252, 254 of flexible snap fastener legs. Each pair of snap fastener legs protrudes through slots in the associated well bottom wall. Each snap fastener leg is provided with a catch 256 which engages a mating shoulder on the adjoining socket wall (182, 184) by a snap fastening action. The side walls of each triangular-shaped fastener are provided with slots 258, 260 respectively, each slot being located between the legs in each fastener leg pair 252, 254. Each slot receives an end portion of the pivot pin 190 in an adjacent leg receiving socket. Thus, each end portion of each pivot pin 190 is captured by a socket wall slot (186, 188) and a fastener slot (258, 260).

Figure 8:
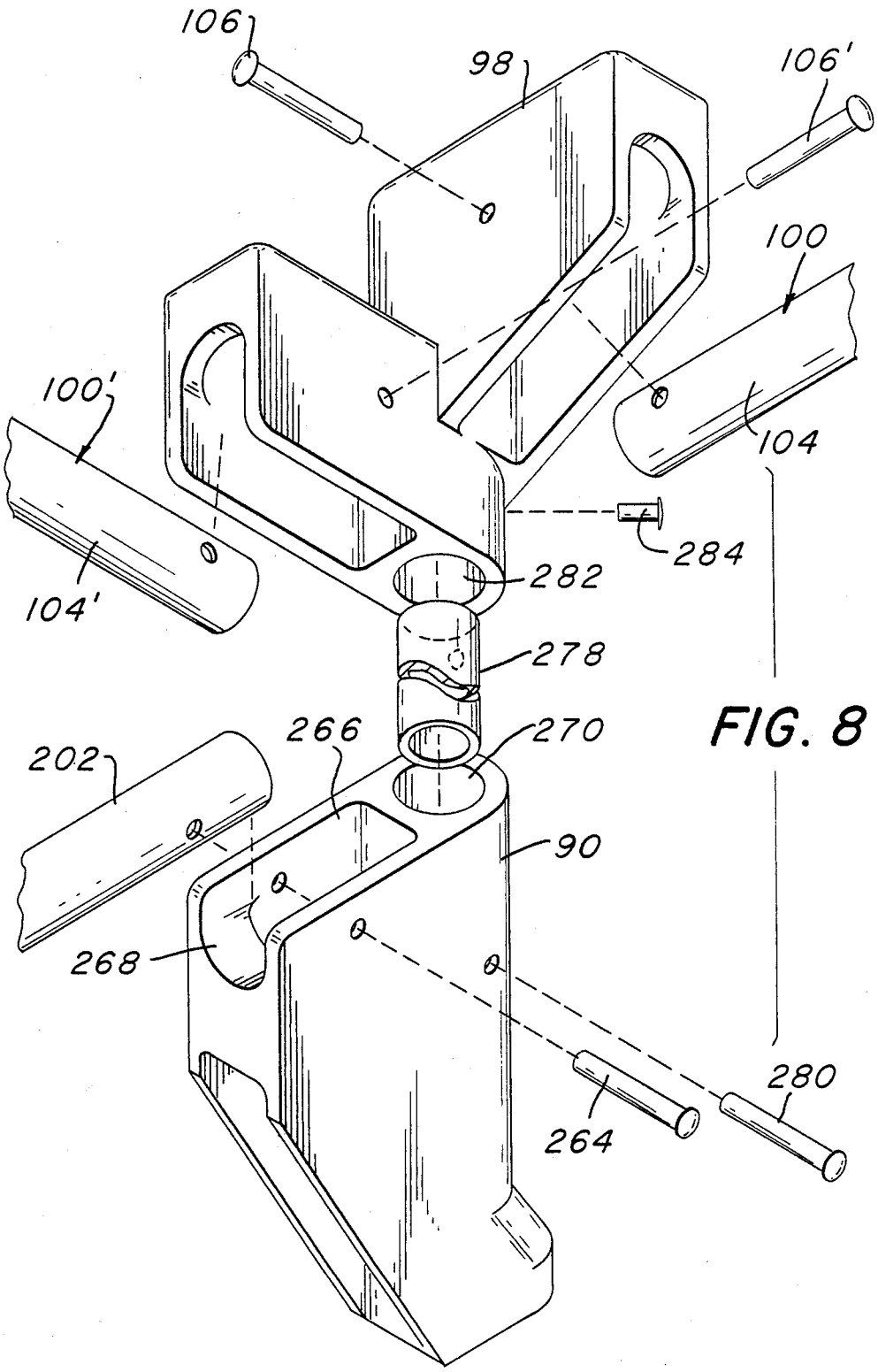
FIG. 8 is an exploded perspective of the support feet and corner rail connecting members.

The central hub member 166 includes a depending leg 262 which serves as a support for the body member and the hub legs when the playyard is erected. See FIG. 11. Hub legs 202, 204, 208, 210 are preferably straight tubular legs, each having an end portion which is pivotably coupled to the central hub member 166 at the leg receiving sockets (FIG. 9) and an opposite end portion which is pivotably coupled to one of the support feet 84, 86, 88, 90 (FIG. 8). The support feet are also part of the lower portion of the playyard frame. As shown in FIG. 8, the opposite end portion of each hub leg (202) is provided with diametrically opposed openings in alignment with like openings in the associated support foot (90) and is pivotably coupled to the support foot by a rivet pin 264 which extends through the aligned hub leg and support foot openings.

Each support foot is provided with a hollow interior portion 266 to accommodate pivoting movement of the hub leg end portion. Each support foot is also provided with a leg support portion 268 which supports the end portion of the hub leg when the leg is swung to the horizontal position to erect the playyard. Each support foot is also provided with a socket 270 for receiving an end portion of one of four rigid tubular metal corner legs 272, 274, 276 and 278. Each corner leg may be made from 22 gauge steel. The corner legs interconnect the upper and lower frame portions of the playyard. The end portion of each corner leg is fixedly secured to the associated support foot by a rivet 280. Each corner rail connecting member 92, 94, 96, 98 is provided with a socket 282 for receiving an opposite end portion of the corner leg as shown in FIG. 8. The end portion of the corner leg is fixedly secured to the associated corner rail connecting member by a rivet 284. Thus, each corner leg is fixedly secured to a corner rail connecting member which is part of the upper frame portion of the playyard and to a support foot which is part of the lower frame portion of the playyard.

The corner legs 272, 274, 276, 278 are spaced apart and upstanding in a substantially parallel configuration as shown in FIG. 3 when the playyard is erected. The hub legs are oriented horizontally in a common plane and the side rails are oriented in-line so as to spread the corner legs in this configuration. The floor portion 64 of the flexible enclosure rests on the hub legs. The hub legs 206, 212 are not coupled to the support feet but are provided to further stabilize the playyard. Each of hub legs 206, 212 includes a generally straight section extending radially outwardly from the hub member 166 and a curved free end or foot portion 286. See FIGS. 4 and 9. Each hub leg 206, 212 is slidably coupled to the enclosure floor portion by a loop or strap 288 (FIG. 4).

Initially, each pair of side rails 100, 102 is collapsed in a V-shaped configuration as shown in FIG. 2 when the playyard is collapsed. Each medial rail connecting member 110 is grasped and pulled upwardly so as to swing rails 100, 102 into a substantially in-line configuration as shown in FIG. 5. As rails 100, 102 swing upwardly, the nose portion 126 of each sprung pin member 122, 124 cammingly engages the sides of holding member 138, causing the pin members to retract against spring pressure until the nose portions clear the holding member. At that point, the pin members snap forwardly to engage the top edge portions of the holding member thereby latching the rails 100, 102 in the in-line configuration. The central hub member 166 is then pushed downwardly so as to move the hub legs to their horizontal positions with the corner legs upstanding. The erected playyard assumes the shape shown in FIG. 3 with the corner legs spread apart by the hub legs and side rails.

Figure 4:
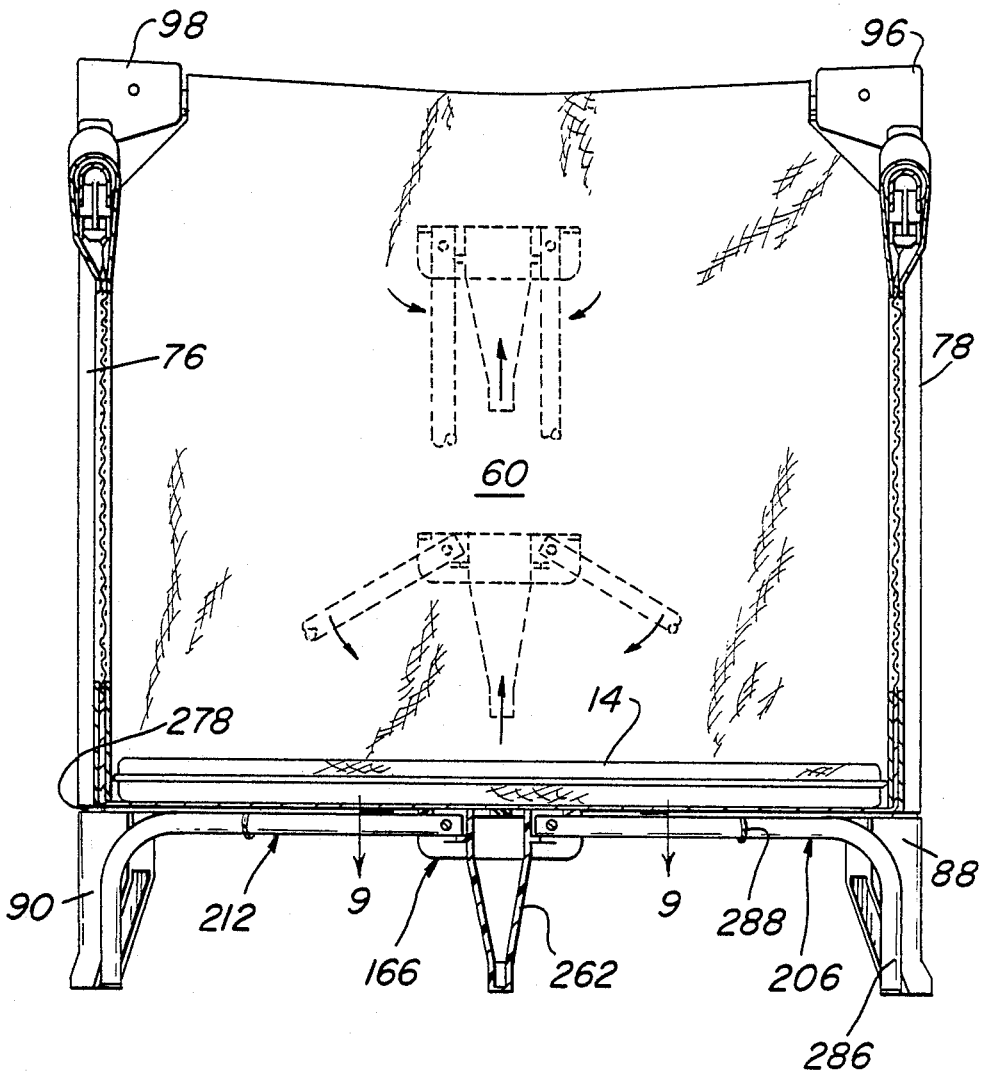
FIG. 4 is a section taken along 4—4 in FIG. 3.
Figure 5:
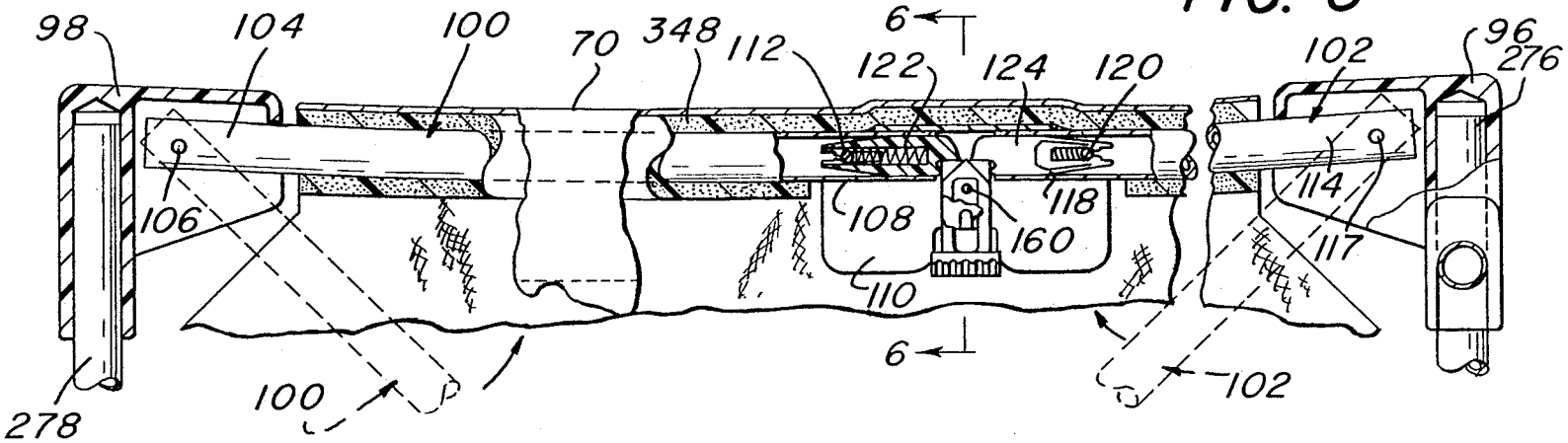
FIG. 5 is a section taken along 5—5 in FIG. 3.

To collapse the playyard, hub member 166 is first pushed upwardly (e.g., approximately 8 inches) so as to pivot the hub legs as shown in phantom in FIG. 4 thereby partially collapsing the lower frame from the horizontal co-planar spread configuration. With the hub legs partially collapsed, the rails 100, 102 of each side rail means can be released from the in-line configuration. Each medial rail connecting member 110 is grasped so as to squeeze the latch release mechanism 144 upwardly whereby the key cam surfaces 156, 158 (FIG. 7) cammingly engage the nose portions of pin members 122, 124, at the lower edge of each nose portion, thereby causing the pin members to retract against spring pressure and clear the top of holding member 138. This releases the rails 100, 102 from the in-line configuration such that the medial rail connecting member 110 can be pushed downwardly so as to collapse the rails towards the V-shaped configuration. With the side rails collapsed, the hub member 166 is pulled upwardly so as to fully collapse the hub legs to the compact non-coplanar configuration wherein the hub legs are substantially parallel. The lower portions of the corner legs, at the support feet, are drawn inwardly towards each other. The upper ends of the corner legs are then gathered towards each other so as to fully collapse the rails in the V-shaped configuration. Thus, the corner legs move from the upstanding spread configuration shown in FIGS. 3 and 4 to the compact configuration shown in FIG. 2. In both configurations of the corner legs, the corner legs are substantially parallel Referring to FIGS. 13–16, there is shown an alternate embodiment of the foldable playyard of the present invention wherein the side rail means and corner rail connecting members have been modified Each of the side rail means includes rigid tubular metal rails 290, 292. Each rail is pivotably coupled at an end portion to a medial rail connecting member 294 by rivet pins 296, 298 respectively. An opposite end portion of each rail is provided with diametrically opposed slots (not numbered). Sprung collars 300, 302 are mounted on these end portions of the rails by rivet pins 304, 306 respectively. Each rivet pin extends through the rail slots and engages an end loop of a spring 308 mounted in a pin member 310. Another end loop of the spring is fastened to a retaining member 312 lodged in the pin member. The pin member is provided with four flexible legs 314, 316, 318, 320, each leg having a recessed, generally concave arcuate surface or groove 322. Each pin member is telescoped within the slotted end portion of its associated rail. The end portion of the rail is crimped or swaged at 324 to provide an annular rib along the interior surface of the rail. The pin member 310 is telescoped within the slotted end portion of its associated rail so that the legs 314, 316, 318, 320 flex towards each other as the legs ride over the interior annular rib. When the concave arcuate surfaces 322 seat on the rib, the legs snap back in place whereby the pin member is secured within the slotted end portion of the rail. The rail, however, is free to rotate about its longitudinal axis on the pin member.

Each pin member is also provided with a nose portion 326 having a bore 328 therethrough. Each pin member is pivotably coupled to one of four corner rail connecting members (two corner rail connecting members 330, 332 being shown in FIGS. 13 and 14) by a rivet pin 338. Each side rail 290, 292, together with medial rail connecting member 294, is therefore rotatable about its longitudinal axis while being pivotable about an axis coincident with rivet pin 338.

Each sprung collar 300, 302 is provided with a cam surface 340 which extends between a shoulder stop 342 and a notch or detent 344. Each corner rail connecting member is provided with a tab 346.

Figure 13:
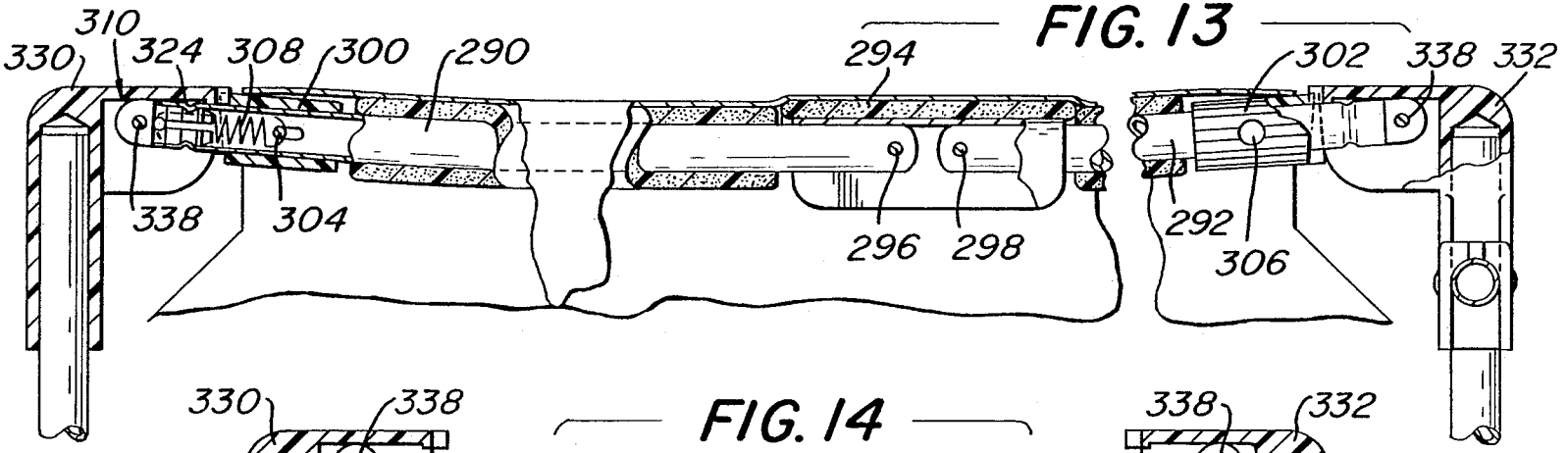
FIG. 13 is a section of an alternative embodiment of the side rail means and corner rail connecting members shown in FIG. 5.

When the playyard is erected, rails 290, 292 are substantially in-line as shown in FIG. 13. Each collar is sprung towards the associated corner rail connecting member such that tab 346 is captured within notch 344. This prevents rotation of the rails and the medial rail connecting member 294 and latches the rails in-line with medial rail connecting member 294 as shown in FIG. 13.

Figure 14:
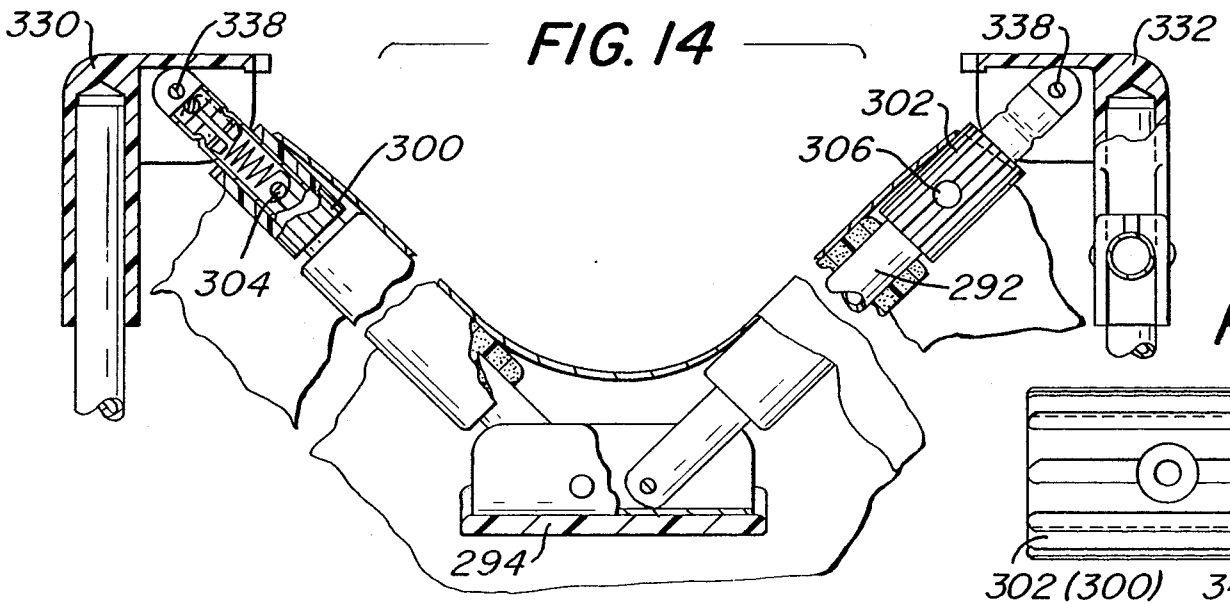
FIG. 14 is a section of the side rail means shown in FIG. 13 in a partially collapsed configuration.
Figure 15:
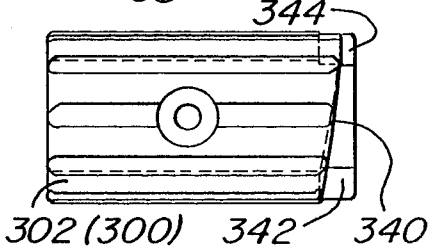
FIG. 15 is a side elevation of the sprung collar shown in FIGS. 13 and 14.
Figure 16:
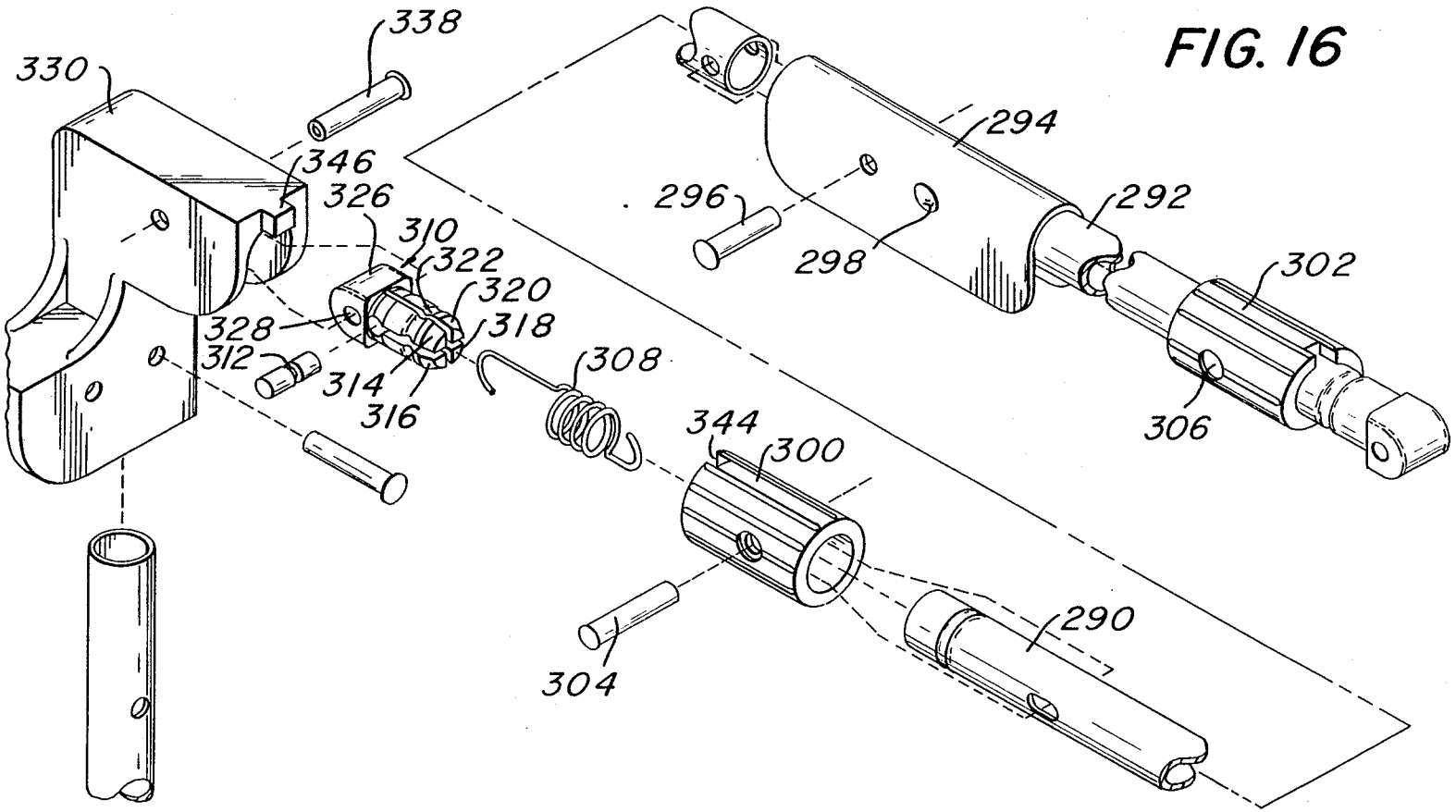
FIG. 16 is an exploded perspective of the components of teh side rail means shown in FIG. 13.

To collapse the playyard, each pair of collars 300, 302 is grasped so as to draw the collars against spring pressure towards the associated medial rail connecting member. This frees each tab 346 from the associated notch or detent 344. The collars are then rotated, together with the rails and the medial rail connecting member, approximately 180° until each tab 346 strikes each shoulder stop 342. This inverts the medial rail connecting member and releases the side rails so that they can be collapsed as shown in FIG. 14. Each of the inverted medial rail connecting members is then pushed downwardly so as to collapse each pair of side rails (290, 292) towards the V-shaped configuration. This draws the upper portions of the corner legs, at the corner rail connecting members, inwardly towards each other. The hub member 106 is then pulled upwardly so as to pivot the hub legs out of the horizontal co-planar spread configuration thereby collapsing the hub legs and drawing the lower portions of the corner legs, at the support feet, towards each other as previously explained. In the collapsed configuration, the hub legs are compactly arranged and substantially parallel. The upper ends of the corner legs are then gathered towards each other so as to fully collapse the rails in the V-shaped configuration. The corner legs assume a compact non-coplanar configuration in which they are substantially parallel to each other. The collapsed playyard has the shape shown in FIG. 2.

To erect the playyard, the hub member is pushed downwardly to bring the hub legs to the horizontal co-planar spread configuration with the corner legs upstanding. The medial rail connecting members are initially inverted as shown in FIG. 14. Each medial rail connecting member is pushed upwardly to bring the associated side rails (290, 292) in-line, with each corner rail connecting member tab 346 in contact with the associated cam surface 340 and shoulder stop 342. Each medial rail connecting member is then grasped (within its associated enclosure sleeve) and rotated approximately 80°, thereby rotating the rails (290, 292) approximately 80° and returning the medial rail connecting member to the non-inverted position shown in FIG. 13. As the rails (290, 292) are rotated, the sprung collars 300, 302 likewise rotate and the cam surface 340 of each collar rides on the associated corner rail connecting member tab 346 thereby retracting the collar against spring pressure. When the collar notch 344 aligns with the tab, the collar snaps forward whereby the tab seats in the notch. This prevents any further rotation of the collar, rail and medial rail connecting member. The rails (290, 292) are now latched in the in-line configuration shown in FIG. 3. This completes the erection of the playyard.

Referring to FIGS. 17–23, there is shown a further embodiment of the foldable playyard of the present invention wherein the side rail means and corner rail connecting members have been modified. Each of the side rail means includes rigid tubular metal rails 390, 392. Each rail is pivotably coupled at an end portion to a medial rail connecting member 394 by rivet pins 396, 398 respectively. An opposite end portion of each rail is provided with diametrically opposed slots (not numbered). Sprung collars 400, 402 are mounted on these end portions of the rail by rivet pins 404, 406 respectively. Each rivet pin extends through the rail slots and engages an end loop of a spring 408 mounted in a pin member 410. Pin member 410 is identical to pin member 310 previously described in connection with FIG. 16. Another end loop of the spring is fastened to a retaining member 412 lodged in the pin member 410. The pin member 410 is provided with four flexible legs 414, 416, 418, 420, each leg having a recessed, generally concave arcuate surface or groove 422. Each pin member is telescoped within the slotted end portion of its associated rail. The end portion of the rail is crimped or swaged at 424 to provide an annular rib along the interior surface of the rail. Pin member 410 is telescoped within the slotted end portion of its associated rail so that the legs 414, 416, 418, 420 flex towards each other as the legs ride over the interior annular rib. When the concave arcuate surfaces 422 seat on the rib, the legs snap back in place whereby the pin member is secured within the slotted end portion of the rail. The rail, however, is free to rotate about its longitudinal axis on the pin member.

Each pin member 410 is also provided with a nose portion 426 having a bore 428 therethrough. Each pin member is pivotably coupled to one of four corner rail connecting members (two corner rail connecting members 430, 432 being shown in FIGS. 17 and 18) by a rivet pin 438. Each side rail 390, 392, together with medial rail connecting member 394, is therefore rotatable about its longitudinal axis while being pivotable about an axis coincident with rivet pin 438.

Figure 19:
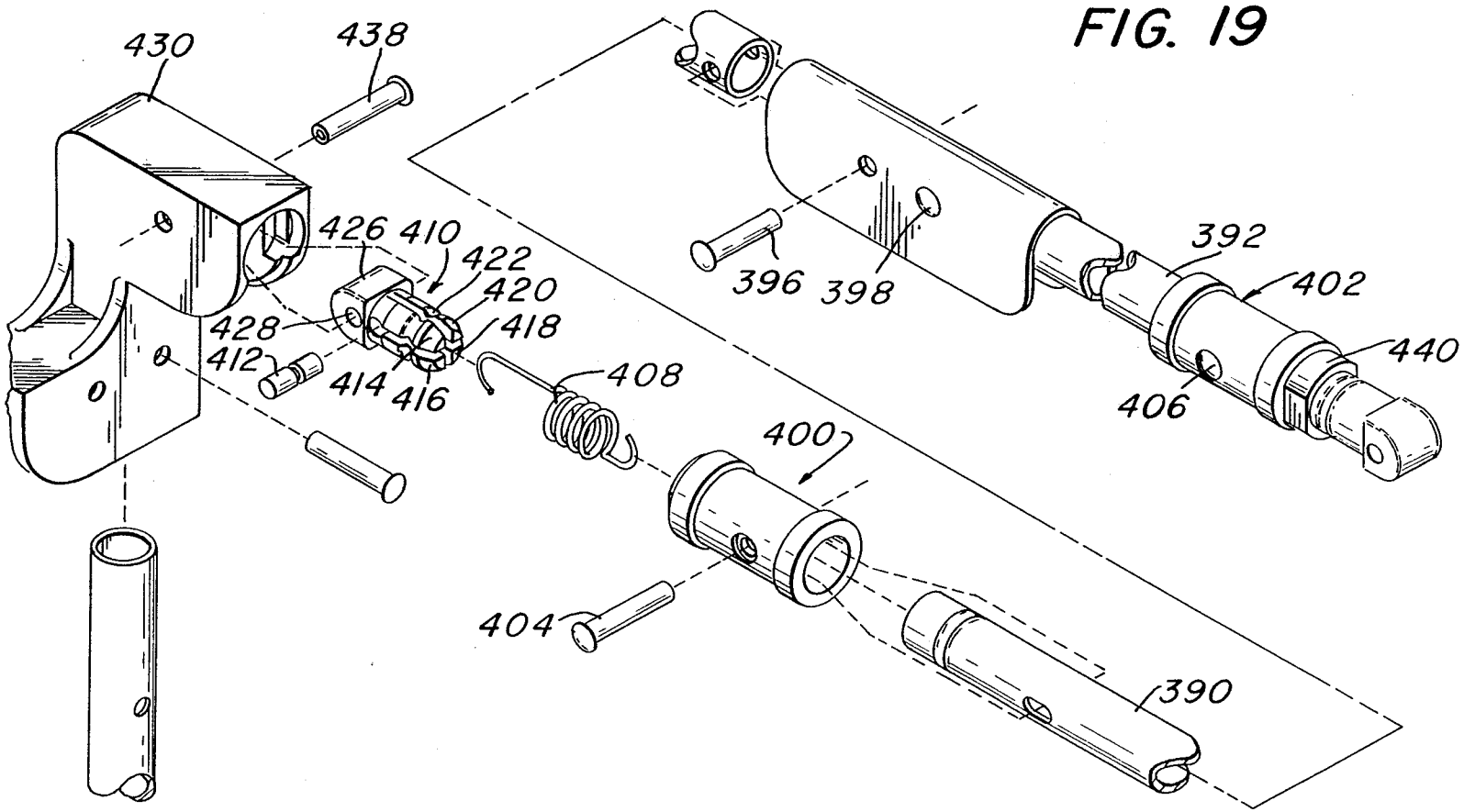
FIG. 19 is an exploded perspective of the components of the side rail means shown in FIG. 17.
Figure 20:
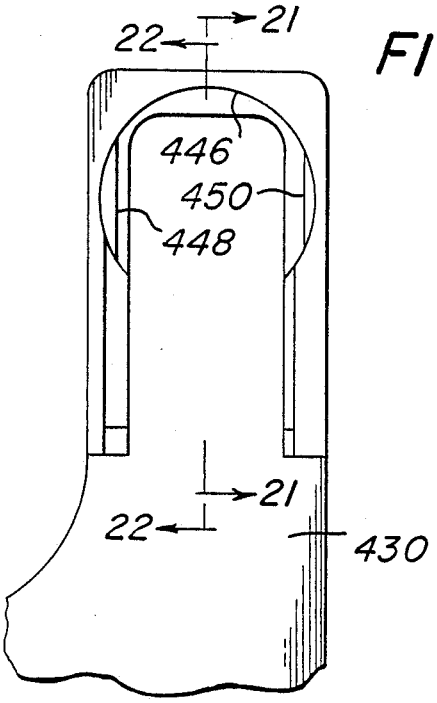
FIG. 20 is an elevation of the corner rail connecting member in FIGS. 17 and 18.
Figure 23:
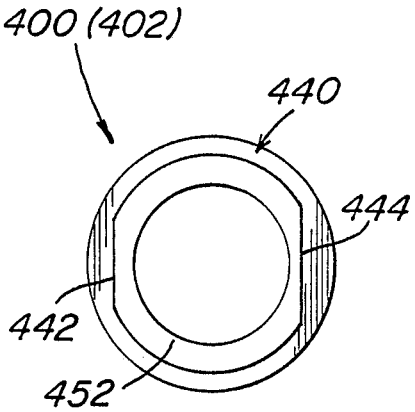
FIG. 23 is a front elevation of the sprung collar shown in FIGS. 17 and 18.

Each sprung collar 400, 402 is provided with a key structure 440 integral therewith as best shown in FIGS. 19 and 23. Key structure 440 is generally cylindrical in shape having two parallel side surfaces 442, 444 of unequal heights (vertical direction in FIG. 23). Side surface 444 is located closer to the central axis of the key than is side surface 442 thereby providing an asymmetric configuration with respect to the central axis of the collar. Each corner rail connecting member is provided with a key receptacle structure (not numbered) comprising a generally cylindrical opening 446 provided with flats 448, 450 of unequal heights (vertical direction in FIG. 20). Flat 448 is located closer to the central axis of opening 446 than is flat 450 thereby providing a key receptacle configuration which is asymmetric with respect to the central axis of the opening.

Figure 17:
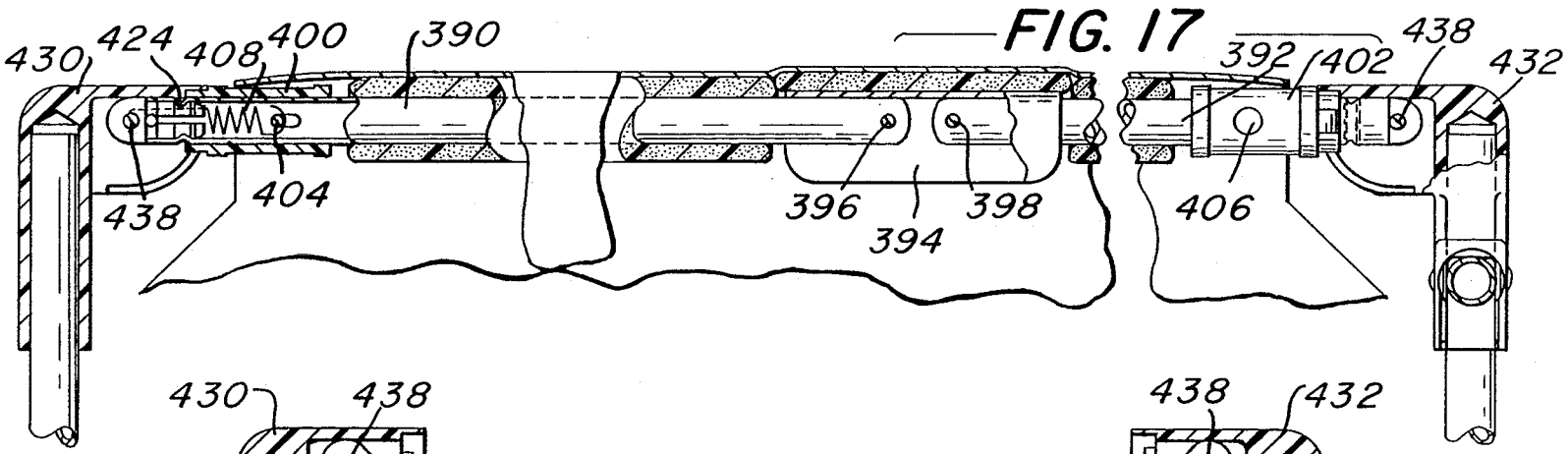
FIG. 17 is a section of a further embodiment of the side rail means and corner rail connecting members shown in FIG. 5.

When the playyard is erected, rails 390, 392 are substantially in-line as shown in FIG. 17. Each collar is sprung towards the associated corner rail connecting member such that key 440 is captured within corner rail connecting member opening 446 between flats 448, 450. This prevents rotation of the rails and the medial rail connecting member 394 and latches the rails in-line with medial rail connecting member 394 as shown in FIG. 17.

Figure 18:
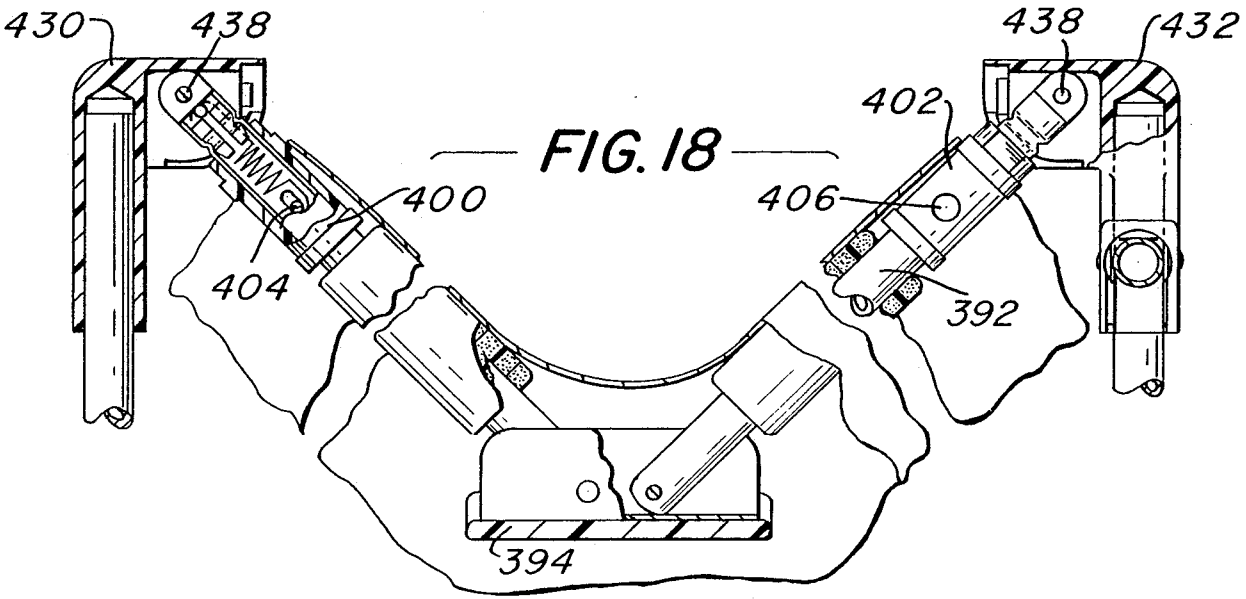
FIG. 18 is a section of the side rail means shown in FIG. 17 in a partially collapsed configuration.

To collapse the playyard, each pair of collars 400, 402 is grasped so as to draw the collars against spring pressure towards the associated medial rail connecting member. This frees each key 440 from the associated corner rail connecting member key receptacle. The collars are then rotated, together with the rails and the medial rail connecting member, approximately 180°. This inverts the medial rail connecting member and releases the side rails so that they can be collapsed from the in-line configuration as shown in FIG. 18. Each of the inverted medial rail connecting members is then pushed downwardly so as to collapse each pair of side rails (390, 392) towards the V-shaped configuration. This draws the upper portions of the corner legs, at the corner rail connecting members, inwardly towards each other. The hub member 166 is then pulled upwardly so as to pivot the hub legs out of the horizontal co-planar spread configuration thereby collapsing the hub legs and drawing the lower portions of the corner legs, at the support feet, towards each other. In the collapsed configuration, the hub legs are compactly arranged and substantially parallel as previously explained. The corner legs assume a compact non-coplanar configuration in which they are substantially parallel to each other. The collapsed playyard has the shape shown in FIG. 2.

Figure 21:
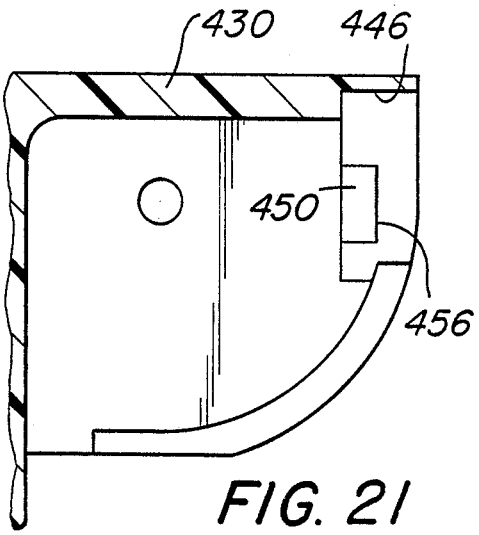
FIG. 21 is a section taken along 21—21 in FIG. 20.
Figure 22:
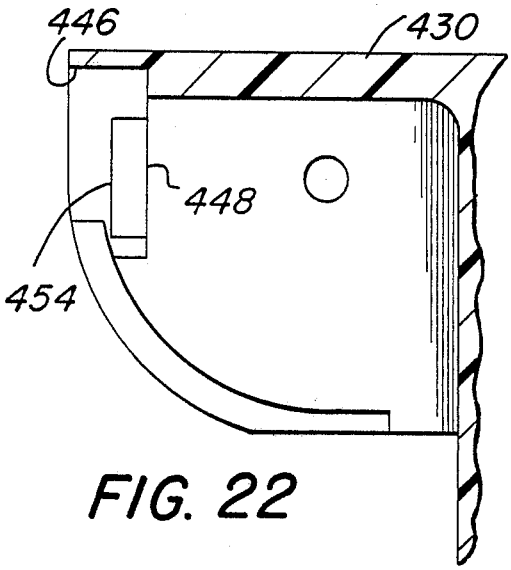
FIG. 22 is a section taken along 22—22 in FIG. 20.

To erect the playyard, the hub member is pushed downwardly to bring the hub legs to the horizontal co-planar spread configuration with the corner legs upstanding. The medial rail connecting members are initially inverted as shown in FIG. 18. Each medial rail connecting member is pushed upwardly to bring the associated side rails (390, 392) in-line, such that each key structure 440 is partially received within the associated corner rail connecting member opening 446 with the front face 452 of the key structure in contact with the front faces 454, 456 of flats 448, 450, respectively (FIGS. 21–23). Each medial rail connecting member is then grasped (within its associated enclosure sleeve) and rotated approximately 180°, thereby rotating the rails (390, 392) approximately 180° and returning the medial rail connecting member to the non-inverted position shown in FIG. 17. As the rails (390, 392) are rotated, the sprung collars, 400, 402 likewise rotate while the key front surface 452 remains in contact with the front surfaces 454, 456 of the flats thereby maintaining each collar retracted against spring pressure. When the key side surfaces 442, 444 align with the flats 450, 448, the collar snaps forward whereby the key is captured in the corner rail connecting member key receptacle. This prevents any further rotation of the collar, rail and medial rail connecting member. The rails (390, 392) are now latched in the in-line configuration shown in FIG. 17. This completes the erection of the playyard.

The foldable playyard of the present invention is easily assembled, erected and collapsed. There is no need to disassemble any parts to collapse the playyard. In collapsing the playyard, the corner legs are drawn to a compact configuration by the hub legs (lower frame assembly) and side rails (upper frame assembly). There is no need to re-assemble any parts to erect the playyard. When erected, the playyard is maintained in a stable configuration with the corner legs upstanding. The corner legs are spread by the hub legs (lower frame assembly) and side rails (upper frame assembly). The playyard is foldable to a compact collapsed configuration wherein it is easily transportable from one location to another. The discrete foldable floor provides a smooth, sturdy cushioned playing surface for the child while being foldable to a box-shaped configuration for housing and transporting the collapsed playyard. If desired, fabric material fasteners, such as Velcro (Trademark) fasteners, can be used instead of snap fasteners 16, 18, 20 to secure the folded floor in the box-shaped configuration.

Figure 6:
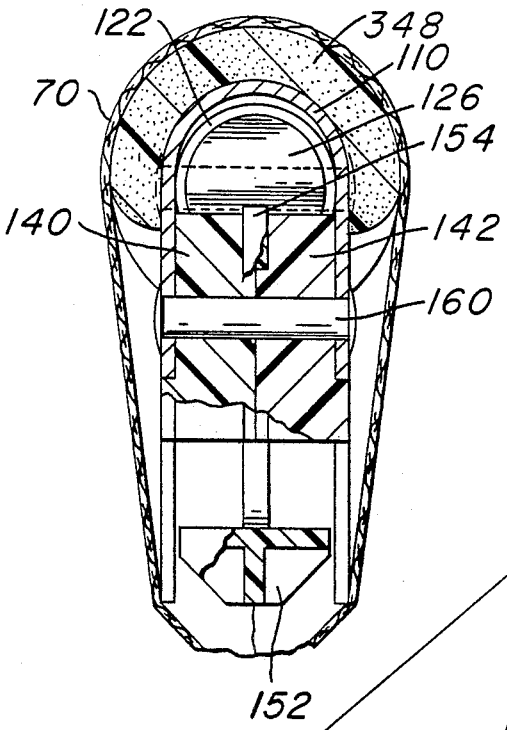
FIG. 6 is a section taken along 6—6 in FIG. 5.

The support feet, corner rail connecting members, hub member, sprung collars and sprung pin members can be molded from a rigid polymeric plastic material. The hub legs, corner legs and side rails can be made of a rigid, lightweight metal material. The flexible fabric enclosure is easily mounted on the corner legs and side rails during assembly but is not removable thereafter. Preferably, the side rail enclosure sleeves 66, 68, 70, 72 are separated from the side rails by foam cushion sleeves 348 as shown in FIGS. 5 and 6.

In all embodiments of the invention, the side rails cannot be inadvertently collapsed by the child. In the embodiment shown in FIGS. 1–12, the side rails can be collapsed only if the hub member is first pulled upwardly so as to partially collapse the corner legs by drawing the lower portions of the corner legs radially inwardly towards the hub member, and then the latch release mechanism is operated. If the hub member is not pulled upwardly, the corner legs remain upstanding in the spread configuration and the latch release mechanism resists operation, not allowing the collapse of the side rails. In each of the embodiments shown in FIGS. 13–23, the sprung collars must first be drawn towards each other against spring pressure to release the side rails, and the hub member can then be pulled upwardly to draw the lower portion of the corner legs towards the hub member. Accordingly, so long as the playyard is erect, a child cannot inadvertently exert a downward force on a medial rail connecting member sufficient to collapse the side rails.

The present invention may be embodied in other specific forms without departing from the spirit or essential attributes thereof and, accordingly, reference should be made to the appended claims, rather than to the foregoing specification, as indicating the scope of the invention.

We claim:

1. Foldable playyard, comprising:

a unitary central hub member, a lower frame assembly comprising corner leg connecting members and hub legs each pivotably coupled at one end portion thereof to said hub member and pivotably coupled at an opposite end portion thereof to one of said lower frame assembly corner leg connecting members such that said hub legs are collapsible by pivoting said hub legs from a substantially co-planar spread configuration wherein said hub legs diverge radially outwardly from said hub member to a compact non-coplanar configuration wherein said hub legs are substantially parallel, an upper frame assembly comprising corner rail connecting members and side rail means each comprising a pair of side rails and a medial rail connecting member disposed therebetween, each of said rails being pivotably coupled at one end portion thereof to one of said upper frame assembly corner rail connecting members and pivotably coupled at an opposite end portion thereof to said medial rail connecting member such that said pair of rails is collapsible by pivoting said rails from a substantially in-line configuration to a substantially V-shaped configuration, and corner legs interconnecting said upper and lower frame assemblies, each fixedly coupled at one end portion thereof to one of said lower frame assembly corner leg connecting members and fixedly coupled at an opposite end portion thereof to one of said upper frame assembly corner rail connecting members such that said corner legs are collapsible radially inwardly towards said hub member from a substantially parallel configuration wherein said corner legs are spread apart by said hub legs and side rail means to a substantially parallel compact configuration wherein said corner legs are drawn together by said hub legs and side rails means.

2. Foldable playyard according to claim 1 wherein each of said side rail means includes latch means for latching said pair of side rails in said substantially in-line configuration and latch release means for releasing said pair of rails from said in-line configuration.

3. Foldable playyard according to claim 1 or claim 2 including a flexible enclosure having side panel portions each attached to adjacent corner legs and to one of said side rail means, said enclosure having a flexible floor portion connected to said side panel portions and located above said hub member.

4. Foldable playyard according to claim 3 including stabilizer legs each disposed between two hub legs and having one end portion thereof pivotably coupled to said hub member and having another free end portion thereof such that said stabilizer legs are collapsible from a substantially co-planar spread configuration to a non-coplanar compact configuration wherein said stabilizer legs are substantially parallel.

5. Foldable playyard according to claim 4 including means for coupling said stabilizer legs to said enclosure floor portion.

6. Foldable playyard, comprising:

a unitary central hub member, a lower frame assembly comprising corner leg connecting members and hub legs each pivotably coupled at one end portion thereof to said hub member and pivotably coupled at an opposite end portion thereof to one of said lower frame assembly corner leg connecting members such that said hub legs are collapsible by pivoting said hub legs from a substantially co-planar spread configuration wherein said hub legs diverge radially outwardly from said hub member to a compact non-coplanar configuration wherein said hub legs are substantially parallel, an upper frame assembly comprising corner rail connecting members and side rail means each comprising a pair of side rails and a medial rail connecting member disposed therebetween, each of said rails being pivotably coupled at one end portion thereof to one of said upper frame assembly corner rail connecting members and pivotably coupled at an opposite end portion thereof to said medial rail connecting member such that said pair of rails is collapsible by pivoting said rails from a substantially in-line configuration to a generally V-shaped configuration; and corner legs interconnecting said upper and lower frame assemblies, each fixedly coupled at one end portion thereof to one of said upper frame assembly corner leg connecting members and fixedly coupled at an opposite end portion thereof to one of said lower frame assembly corner rail connecting members such that said corner legs are collapsible radially inwardly towards said hub member from a substantially parallel configuration wherein said corner legs are spread apart by said hub legs and side rail means to a substantially parallel compact configuration wherein said corner legs are drawn together by said hub legs and side rail means, each of said side rail means including latch means for latching said pair of rails in said substantially in-line configuration and latch release means for releasing said pair of rails from said in-line configuration, each latch means including a pair of oppositely sprung pin members, each pin member being at least partially telescoped within one of said rail end portions which is pivotably coupled to said medial rail connecting member, and a holding member coupled to said medial rail connecting member between said pin members.

7. Foldable playyard according to claim 6 including a flexible enclosure having side panel portions each attached to adjacent corners legs and to one of said side rail means, said enclosure having a flexible floor portion connected to said side panel portions and located above said hub member.

8. Foldable playyard according to claim 7 including stabilizer legs each disposed between two hub legs and having one end portion thereof pivotably coupled to said hub member and having another free end portion thereof such that said stabilizer legs are collapsible from a substantially co-planar spread configuration to a non-coplanar compact configuration wherein said stabilizer legs are substantially parallel.

9. Foldable playyard according to claim 6 wherein each of said sprung pin members is provided with a cam surface portion for cammingly contacting said holding member such that said pin member retracts against spring pressure, and a latch surface portion for engaging said holding member under spring pressure.

10. Foldable playyard according to claim 6 wherein each latch release means includes a latch release member slidably coupled to said holding member said latch release member being provided with a cam surface portion for cammingly contacting said sprung pin members such that said pin members retract against spring pressure and disengage said holding member.

11. Foldable playyard according to claim 8 including means for coupling said stabilizer legs to said enclosure floor portion.

12. Foldable playyard comprising:

a unitary central hub member, a lower frame assembly comprising corner leg connecting members and hub legs each pivotably coupled at one end portion thereof to said hub member and pivotably coupled at an opposite end portion thereof to one of said lower frame assembly corner leg connecting members such that said hub legs are collapsible by pivoting said hub legs from a substantially co-planar spread configuration wherein said hub legs diverge radially outwardly from said hub member to a non-coplanar compact configuration wherein said hub legs are substantially parallel, an upper frame assembly comprising corner rail connecting members and side rail means each comprising a pair of rails and a medial rail connecting member disposed therebetween, each of said rails being pivotably coupled at one end portion thereof to said medial connecting member and being pivotably and rotatably coupled at an opposite end portion thereof to one of said upper frame assembly corner rail connecting members such that said pair of rails is collapsible by pivoting said rails from a substantially in-line configuration to a generally v-shaped configuration, corner legs interconnecting said upper and lower frame assemblies, each fixedly coupled at one end portion thereof to one of said upper frame assembly corner leg connecting members and fixedly coupled at an opposite end portion thereof to one of said lower frame assembly corner rail connecting member such that said corner legs are collapsible radially inwardly toward said hub from a substantially parallel configuration wherein said corner legs are spread apart by said hub legs and side rail means to a substantially parallel compact configuration wherein said corner legs are drawn together by said hub legs and side rails means, each of said side rail means including means for selectively latching said side rails in and releasing said side rails from said substantially in-line configuration by rotation of said side rails.

13. Foldable playyard according to claim 12 including a flexible enclosure having side panel portions each attached to adjacent corner legs and to one of said side rails means, said enclosure having a flexible floor portion connected to said side panel portions and located above said hub member.

14. Foldable playyard according to claim 13 including stabilizer legs each disposed between two hub legs and having one end portion thereof pivotably coupled to said hub member and having another free end portion thereof such that said stabilizer legs are collapsible from a substantially co-planar configuration to a non-coplanar compact configuration wherein said stabilizer legs are substantially parallel.

15. Foldable playyard according to claim 14 including means for coupling said stabilizer legs to said enclosure floor portion.

16. Foldable playyard according to claim 12 wherein said means for selectively latching and releasing said side rails includes a pair of oppositely sprung collar members, each collar member being mounted on an end portion of one of said rails so as to be slidable thereon and rotatable therewith, each collar member being provided with a portion for engaging and interlocking with a portion of an upper frame assembly corner rail connecting member so as to prevent rotation of said collar member.

17. Foldable playyard according to claim 16 wherein said collar member includes a cam surface for cammingly contacting said portion of said upper frame assembly corner rail connecting member such that rotation of said collar member causes said collar member to retract against spring pressure.

18. Foldable playyard according to claim 16 wherein said collar member portion includes a key portion and said upper frame assembly corner rail connecting member portion includes a key receptacle for capturing said key portion at a predetermined rotative position of said collar member.

19. Foldable playyard according to any one of claims 1, 6 and 12 including a discrete foldable floor having rigid sections and means for foldably connecting said rigid sections such that said sections are collapsible from a substantially co-planar configuration to a non-coplanar generally box-shaped configuration for storing said playyard.

20. Foldable playyard according to claim 19 wherein said foldable floor is provided with fasteners for securing said sections in said generally box-shaped configuration and a strap for carrying said foldable floor in said generally box-shaped configuration.

21. Foldable playyard according to any one of claims 1, 6 and 12 including a center support member connected to said hub member and depending therefrom.

22. Apparatus for latching a pair of rails in substantially in-line configuration, comprising a medial rail connecting member disposed between said rails, each rail being pivotably coupled at one end portion thereof to said medial rail connecting member, a pair of oppositely sprung pin members, each pin member being at least partially telescoped within one of said rail end portions, and a holding member coupled to said medial rail connecting member between said pin members, each sprung pin member being provided with a cam surface portion for cammingly contacting said holding member such that said pin member retracts against spring pressure and a latch surface portion for engaging said holding member under spring pressure.

23. Apparatus according to claim 22 including means for releasing said rails from said substantially in-line configuration comprising a latch release member slidably coupled to said holding member and having a cam surface portion for cammingly contacting said sprung pin members such that said pin members retract against spring pressure and disengage said holding member.

24. Apparatus for selectively latching a pair of rails in and selectively releasing a pair of rails from a substantially in-line configuration between a pair of rail end connecting members, comprising a medial rail connecting member disposed between said rails, each of said rails being pivotably coupled at one end portion thereof to said medial rail end connecting member and being pivotably and rotatably coupled at an opposite end portion thereof to one of said rail end connecting members, and a pair of oppositely sprung collar members each mounted on one of said opposite end portions of said rails so as to be slidable thereon and rotatable therewith, each collar member having a portion for engaging and interlocking with a portion of a rail end connecting member so as to prevent rotation of said collar member.

25. Apparatus according to claim 24 wherein said collar member includes a cam surface for cammingly contacting said portion of said rail end connecting member such that rotation of said collar member causes said collar member to retract against spring pressure.

26. Apparatus according to claim 24 wherein said collar member portion includes a key portion and said rail end connecting member portion includes a key receptacle for capturing said key portion at a predetermined rotative position of said collar member.

* * * * *